US012768564B2

(12) United States Patent
Jiang et al.

(10) Patent No.: US 12,768,564 B2
(45) Date of Patent: Oct. 20, 2026

(54) DRIVE MECHANISM AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Fenghua Jiang, Foshan (CN); Fuxing Zhai, Foshan (CN); Zhihui Mu, Foshan (CN); Biao Huang, Foshan (CN); Zheyuan Zhang, Foshan (CN); Qiwei Liu, Foshan (CN); Hongliang Yuan, Foshan (CN); Bingchao Su, Foshan (CN); Wuyun Zhu, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 569 days.

(21) Appl. No.: 18/138,998

(22) Filed: Apr. 25, 2023

(65) Prior Publication Data

US 2023/0258364 A1 Aug. 17, 2023

Related U.S. Application Data

(63) Continuation of application No. PCT/CN2021/091666, filed on Apr. 30, 2021.

(30) Foreign Application Priority Data

Dec. 11, 2020 (CN) ..... 202011471321.1
Dec. 11, 2020 (CN) ..... 202011471322.6
(Continued)

(51) Int. Cl.
*F24F 13/10* (2006.01)

(52) U.S. Cl.
CPC ..... *F24F 13/10* (2013.01)

(58) Field of Classification Search
CPC .. F24F 13/10; F24F 13/06; F24F 13/08; F24F 13/082; F24F 13/084; F24F 2013/088;
(Continued)

(56) References Cited

U.S. PATENT DOCUMENTS

2006/0137884 A1 6/2006 Torres
2015/0075201 A1* 3/2015 Park ..... F25D 17/04 454/324

FOREIGN PATENT DOCUMENTS

CN 102194569 A 9/2011
CN 106369777 A 2/2017
(Continued)

OTHER PUBLICATIONS

Peng, Daijie, CN109945309 Translation.pdf, "Air conditioner indoor unit", Jun. 2019, pp. 1-29.*
(Continued)

*Primary Examiner* — Avinash A Savani
*Assistant Examiner* — Ryan L Faulkner
(74) *Attorney, Agent, or Firm* — Scully, Scott, Murphy & Presser, P.C.

(57) ABSTRACT

A drive mechanism and an air conditioner are provided. The drive mechanism includes a base, two moveable plates and a rectifying guide rail. The base is provided with two guiding slides. The two moveable plates slidably cooperate with the base via the two guiding slides correspondingly. The rectifying guide rail is fixed to the base. The rectifying guide rail is spaced from the guiding slide. The rectifying guide rail cooperates with at least one of the two moveable plates.

30 Claims, 11 Drawing Sheets

(30) Foreign Application Priority Data

Dec. 11, 2020 (CN) ..... 202023002577.6
Dec. 11, 2020 (CN) ..... 202023003507.2
Dec. 11, 2020 (CN) ..... 202023003775.4

(58) Field of Classification Search
CPC .. F24F 13/12; F24F 13/142; F24F 2013/1473; F24F 13/1486; F24F 2013/205
USPC ..... 454/333, 220, 222, 298, 324, 344
See application file for complete search history.

(56) References Cited

FOREIGN PATENT DOCUMENTS

| | | | | | |
|---|---|---|---|---|---|
| CN | 106705239 | A | | 5/2017 | |
| CN | 206214064 | U | | 6/2017 | |
| CN | 109945309 | A | * | 6/2019 | ..... F24F 1/0014 |
| CN | 209150838 | U | | 7/2019 | |
| CN | 211345754 | U | | 8/2020 | |
| CN | 211575458 | U | | 9/2020 | |
| CN | 211823047 | U | | 10/2020 | |
| CN | 211977034 | U | | 11/2020 | |
| CN | 214506398 | U | | 10/2021 | |
| CN | 215221593 | U | | 12/2021 | |
| EP | 2848872 | A1 | | 3/2015 | |
| EP | 3614058 | A1 | | 2/2020 | |
| JP | 2002012098 | A | | 1/2002 | |
| KR | 20200111438 | A | | 9/2020 | |

OTHER PUBLICATIONS

Hakjae, Kim, KR20200111438 Translation.pdf, "indoor unit for air conditioner", Sep. 2020, pp. 1-92.*
Atsushi, Yamashita, CN1860336 Translation.pdf, "Indoor unit of air conditioner", Nov. 2006, pp. 1-30.*
Supplementary European Search Report dated Apr. 9, 2024 received in European Patent Application No. EP 21901940.3.
First Office Action dated Dec. 4, 2024 received in Chinese Patent Application No. 202011471322.6.
First Office Action dated Dec. 31, 2024 received in Chinese Patent Application No. 202011471321.1.
International Search Report and Written Opinion dated Sep. 15, 2021 received in International Application No. PCT/CN2021/091666.

* cited by examiner

DRIVE MECHANISM AND AIR CONDITIONER

CROSS-REFERENCE TO RELATED APPLICATIONS

The present application is a continuation application of PCT International Patent Application No. PCT/CN2021/091666, filed on Apr. 30, 2021 which claims priority to and benefits of Chinese Patent Application Nos. 202011471322.6, 202023003775.4, 202023003507.2, 202011471321.1, and 202023002577.6, all filed on Dec. 11, 2020, the entire contents of each of which are incorporated herein by reference for all purposes. No new matter has been introduced.

FIELD

The present application relates to the field of air conditioners, and in particular to a drive mechanism and an air conditioner.

BACKGROUND

Nowadays, the air conditioners with breezeless mode usually adopt the diffuser panel to disperse airflow to achieve the breezeless effect, but the current solution is to drive the air blocking assembly to move up and down to make the air conditioner switch between the ordinary air supply and breezeless air supply.

However, during the drive mechanism driving the air blocking assembly to move up and down, the air blocking assembly often does not move smoothly, and a part of the motor wire also moves up and down together, but this part of the motor wire easily bends by a large angle or mutually winds to knot when moving up and down, the motor wire is easy to fatigue and be damaged when in such cases for a long time, to affect the service life of the air conditioner. The drive mechanism needs to be connected to the power cord, and the power cords in the current air conditioner indoor unit are arranged messily on the rear surface of the panel.

The above is only used to assist in understanding the technical solution of the present application, and does not mean that the above is acknowledged as prior art.

SUMMARY

The main objective of the present application is to at least provide a drive mechanism, which aims to at least solve the above technical problem of the air conditioner.

In order to achieve the above purpose, the drive mechanism provided by the present application includes:

- a base provided with two guiding slides;
- two moveable plates slidably cooperating with the base via the two guiding slides correspondingly; and
- a rectifying guide rail fixed to the base. The rectifying guide rail is spaced from the guiding slide, and the rectifying guide rail cooperates with at least one of the two moveable plates.

In an embodiment, the base is provided with a wire through groove, and the wire through groove is provided with a wire inlet.

In an embodiment, the drive mechanism further includes a drive motor, each moveable plate is provided with the drive motor, the drive motor is connected with a motor wire, the motor wire enters into the wire through groove via the wire inlet, and the wire through groove is provided with a first guiding portion for guiding the motor wire at the wire inlet.

In an embodiment, the wire through groove is spaced from the drive motor in a direction perpendicular to a sliding direction of the moveable plate.

In an embodiment, the first guiding portion is extended upward and inclinedly from the wire inlet, or the first guiding portion is extended downward and inclinedly from the wire inlet.

In an embodiment, two first guiding portions are provided at the wire inlet, one of the two first guiding portions is curved downward from the wire inlet, and the other of the two first guiding portions is curved upward from the wire inlet.

In an embodiment, the drive mechanism further includes a sliding drive assembly connected to the moveable plate, and a wire connected to the sliding drive assembly is provided on a side of the base towards a housing.

In an embodiment, the base includes a substrate and two flanks provided at two ends of the substrate respectively, the substrate is provided with a first side edge whose one end extends toward to another end, the two flanks protrude from the first side edge, and the two moveable plates are provided on the two flanks, respectively.

In an embodiment, the sliding drive assembly includes a motor box and a stepper motor, the motor box is mounted in the flank, the motor box is located between the moveable plate and the flank, the stepper motor is mounted in the motor box, and the motor box is provided with a first wire groove, and a wire connected to the stepper motor is provided in the first wire groove.

In an embodiment, the first wire groove on the motor box in one of the two flanks is provided with an opening towards the other of the two flanks.

In an embodiment, a first wire clamping is provided at the opening of the first wire groove.

In an embodiment, the base includes a substrate and two flanks provided at two ends of the substrate respectively, the substrate is provided with a first side edge whose one end extends toward to another end, the two flanks protrude from the first side edge, and at least one of the two flanks is provided with the rectifying guide rail.

In an embodiment, the rectifying guide rail is located between the two guiding slides.

In an embodiment, each flank is provided with an inner side edge adjacent to the first side edge of the substrate, and the rectifying guide rail is mounted on the inner side edge.

In an embodiment, the inner side edge of the flank is provided with an edge plate, and the rectifying guide rail is clamped to the edge plate.

In an embodiment, the rectifying guide rail includes a rectifying slide groove and a rectifying rib provided in the rectifying slide groove, the rectifying slide groove is socketed with the edge plate, the moveable plate is provided with a guiding groove, and the guiding groove slidingly cooperates with the rectifying rib.

In an embodiment, on a same flank, an opening of the rectifying slide groove is oriented towards the guiding slide, and the rectifying rib is located on a side of the rectifying slide groove away from to the guiding slide.

In an embodiment, the edge plate is provided with a fixing hole, and an inner wall of the rectifying slide groove is provided with a clamping table corresponding to the fixing hole.

In an embodiment, the clamping table is of a triangular shape.

In an embodiment, each flank is provided with a first fixing groove located on an inner side of the edge plate, the rectifying slide groove is provided with two side edges that extend in a sliding direction of the edge plate, one of the two side edges is provided with a first clasp table for clasping the edge plate, and the other of the two side edges is provided with a second clasp table that cooperates with the first fixing groove.

In an embodiment, the first side edge of the substrate is provided with a stop portion, a second fixing groove is provided between the stop portion and the edge plate, and the rectifying slide groove is inserted into the second fixing groove.

In an embodiment, the clamping table and the second clasp table are provided at an end of the rectifying slide groove away from the substrate.

In an embodiment, the guiding groove is provided with two opposite side walls, each side of the rectifying rib is provided with at least two curved protrusions, and the curved protrusions located on the two sides of the rectifying guide rail are abutted against the two side walls of the guiding groove correspondingly.

In an embodiment, the rectifying guide rail includes a rectifying slide groove, the moveable plate is provided with a guiding portion, and the guiding portion is slidably provided in the rectifying slide groove.

In an embodiment, the rectifying guide rail further includes a rectifying rib provided on an inner wall of the rectifying slide groove, and the rectifying rib is abutted against the guiding portion.

In an embodiment, each flank is provided with the rectifying guide rail, and the two rectifying guide rails are staggered in the direction perpendicular to the sliding direction of the moveable plate.

In an embodiment, the drive mechanism further includes a panel. The moveable plate is located between the base and the panel.

In an embodiment, the drive mechanism further includes a sliding drive assembly, the sliding drive assembly including a stepper motor and a first gear, the guiding slide is fixed on the moveable plate, the guiding slide is slidingly provided on the base, and the guiding slide is provided with a rack engaged with the first gear.

In order to achieve the above purpose, the present application also provides an air conditioner, including a drive mechanism and an air blocking assembly, the drive mechanism including:

a base provided with two guiding slides;

two moveable plates slidably cooperating with the base via the two guiding slides correspondingly; and a rectifying guide rail fixed to the base, where the rectifying guide rail is spaced from the guiding slide, and the rectifying guide rail cooperates with at least one of the two moveable plates;

where the air blocking assembly is connected to two moveable plates, and the air blocking assembly is accommodated inside the housing when in a first state and blocks in front of an indoor air outlet when in a second state.

In an embodiment, the air blocking assembly is a baffle plate, a microplate or a cyclone module. The baffle plate is configured to block an airflow from the indoor air outlet being blown out forward, the microplate is configured to break up the airflow for being blown out, and the cyclone module is configured to direct the airflow to rotate and be blown out.

In the technical solution of the present application, the sliding of the moveable plate is smoother by setting a rectifying guide rail on the flank. Since a first guiding portion is provided at the wire inlet of the wire through groove through which the motor wire connected to the drive motor passes, so that when the motor wire swings up and down, the first guiding portion can guide the motor wire, to reduce a bending angle of the motor wire and slow down the breakage of the motor wire due to fatigue. Since moveable plates are provided at two ends of the base and a sliding drive assembly is provided on the base, and then the wire connected to the sliding drive assembly is hidden in the base, to avoid the messy wiring of the wires connected to the sliding drive assembly.

BRIEF DESCRIPTION OF THE DRAWINGS

In order to more clearly illustrate the technical solutions in the embodiments of the present application or in the prior art, the following is a brief description of the drawings in the embodiments or in prior art, it is obvious that the drawings in the following description are only some of the embodiments of the present application, other structures can be obtained by those skilled in the art according to the structure shown in drawings without creative work.

DESCRIPTION OF REFERENCE SIGNS

Figure 1:
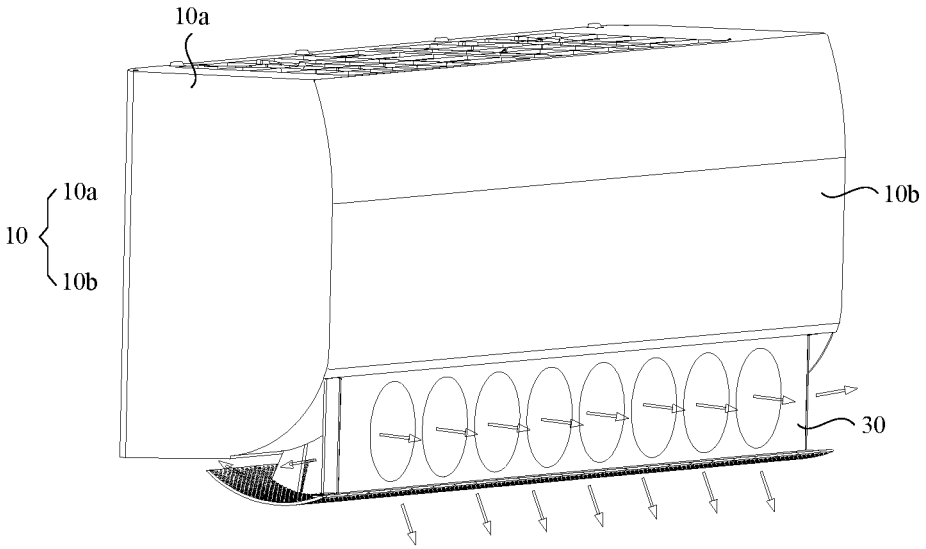
FIG. 1 is a schematic structural view of an air conditioner indoor unit according to an embodiment of the present application.

| Reference sign | Name |
|---|---|
| 10 | housing |
| 10a | face frame |
| 10b | panel |
| 101 | air outlet |
| 20 | base |
| 20a | substrate |
| 20b | flank |
| 20c | motor box |
| 20d | moveable plate |
| 20e | rectifying guide rail |
| 20f | guiding slide |
| 20g | wire |
| 30 | air blocking assembly |
| 300 | air hole |
| 301 | fan blade |
| 201 | first side edge |
| 202 | second wire groove |
| 203 | wire hole |
| 204 | pressing wire plate |
| 205 | second wire clamping |
| 206 | avoidance gap |
| 220a | stepper motor |
| 220b | drive motor |
| 211 | recess |
| 212, 212' | edge plate |
| 212a | fixing hole |
| 212b | first fixing groove |
| 213 | stop portion |
| 213a | second fixing groove |
| 214 | insertion hole |
| 215 | screw post |
| 216 | positioning post |
| 221a | first gear |
| 221b | second gear |
| 222 | recessed portion |
| 223 | first wire groove |
| 224 | guiding slide groove |
| 225a | lug |
| 225b | screw hole |
| 225c | positioning hole |
| 226 | first wire clamping |
| 227 | wire through groove |
| 228 | wire inlet |
| 229 | first guiding portion |
| 231a, 231b | rectifying slide groove |
| 232a, 232b | rectifying rib |
| 233 | second column |
| 233a | curved protrusion |
| 234 | first clasp table |
| 235 | second clasp table |
| 236 | clamping table |
| 241 | rack plate |
| 242 | track plate |
| 243 | first column |
| 251a | guiding groove |
| 251b | guiding portion |

-continued

| Reference sign | Name |
|---|---|
| 261 | second guiding portion |
| 262 | wire-winding portion |

The realization of the purpose, functional features and advantages of the present application will be combined with the embodiments, with reference to the drawings for further explanation.

DETAILED DESCRIPTION OF EMBODIMENTS

The technical solutions in the embodiments of the present application will be clearly and completely described below in conjunction with the drawings in the embodiments of the present application. Obviously, the described embodiments are only some of the embodiments of the present application, and not all of them. Based on the embodiments in the present application, all other embodiments obtained by those skilled in the art without creative labor fall within the scope of the present application.

It should be noted that all directional indications (such as up, down, left, right, forward, backward . . . ) in the embodiments of the present application are used only to explain the relative positions and movements of the parts in a particular posture (as shown in the drawings), and if this particular posture is changed, the directional indications are changed accordingly.

Furthermore, the terms "first" and "second" in the present application are for descriptive purposes only, and are not to be understood as indicating or implying their relative importance or implicitly specifying the number of technical features indicated. Thus, the features defined with "first" and "second" may explicitly or implicitly include at least one such feature. In addition, the technical solutions of each embodiment can be combined with each other, but only on the basis that the those skilled in the art can achieve, when the combination of technical solutions appear contradictory or cannot be achieved, it should be considered that such combination of technical solutions does not exist, and is not within the scope of the present application.

The present application proposes a drive mechanism and an air conditioner mounted with the drive mechanism. The air conditioner may be a split-type air conditioner or integral air conditioner. For a split-type air conditioner, it can be a wall-mounted air conditioner, a floor-mounted air conditioner, an air duct unit, a ceiling-mounted air conditioner, a ceiling unit, etc. For an integral air conditioner, it can be a window unit, a mobile air conditioner, etc.

Figure 2:
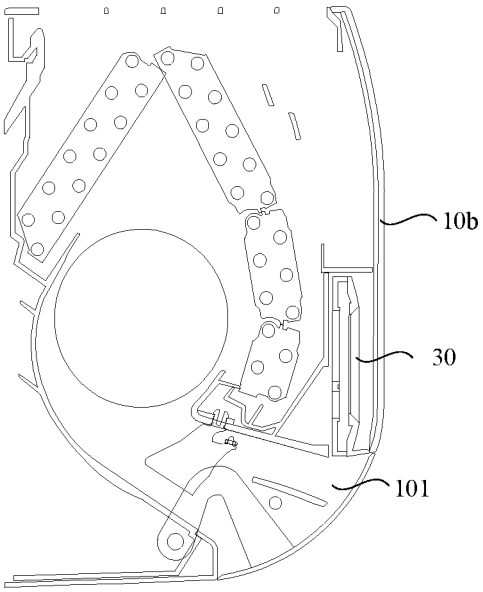
FIG. 2 is a schematic cross-sectional view of the air conditioner indoor unit in FIG. 1, in which the air blocking assembly is hidden on a rear side of the panel.
Figure 3:
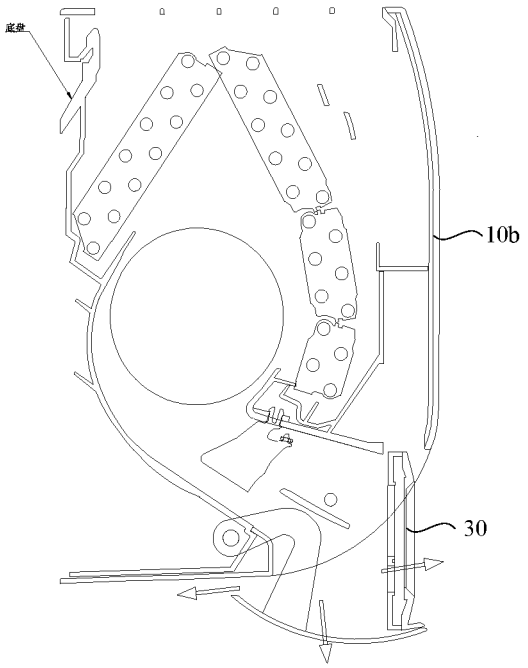
FIG. 3 is a schematic cross-sectional view of the air conditioner indoor unit in FIG. 1, in which the air blocking assembly is moved to a front side of the panel.

Referring to FIGS. 1 to 3, the drive mechanism is described by taking a wall-mounted air conditioner indoor unit as an example. The air conditioner indoor unit includes a housing 10, and the housing 10 includes a face frame 10*a* and a panel 10*b* mounted on the face frame 10*a*, and an air outlet 101 is provided on the face frame 10*a*, and the air outlet 101 can be located below the panel 10*b*. An inner side of the panel 10*b* is provided with a drive mechanism, and the drive mechanism is connected to the air blocking assembly 30, which is mounted on the drive mechanism and can slide up and down, so that the air blocking assembly 30 is accommodated inside the housing 10*b* when in a first state, and blocks in front of the indoor air outlet 101 when in a second state, such that the air outlet mode is switched.

It should be noted that there are various forms of the air blocking assembly 30, such as a baffle plate, a microplate or a cyclone module, where the baffle plate is used to block the airflow from the air outlet 101 being blown out forward, the microplate is used to break up the airflow for being blown out and the cyclone module is used to guide the airflow to rotate and be blown out. The baffle plate blocks in front of the air outlet 101, to change the direction of the air coming out of the air outlet 101, so that the air outlet 101 sends air downward. The micro-hole plate blocks in front of the air outlet 101, to make the airflow to go through the micro-hole, so that the airflow is broken up, and the air speed and air volume are reduced. The cyclone module is provided with an air hole 300, and a fan blade 301 is provided inside the air hole 300, the fan blade 301 can actively rotate or passively rotate. When the airflow is blown out from the air outlet 101 and passes through the air hole 300, the fan blade 301, whether actively rotates or passively rotates, can send the airflow out in a rotating manner, and the rotating airflow is blown out and mixed with the surrounding air, so that the airflow blown out is more softly.

The structure of the drive mechanism is described in detail below.

Figure 4:
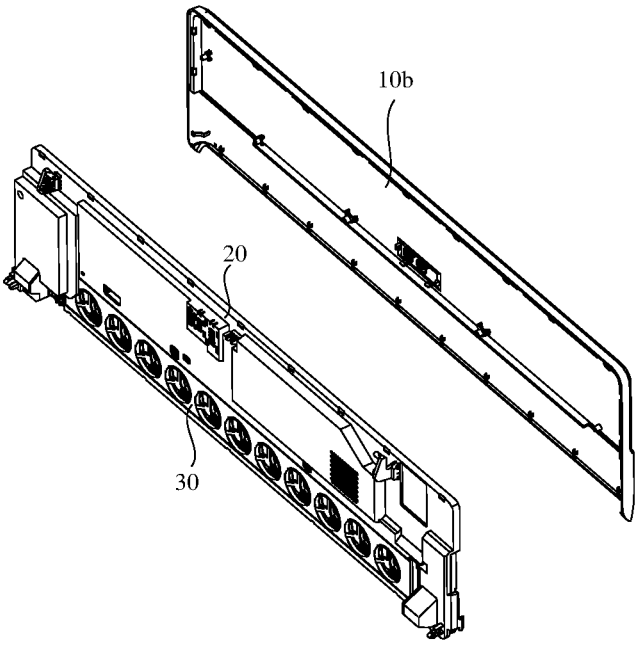
FIG. 4 is a schematic view of an assembly structure of the panel, a drive mechanism and an air blocking assembly of the air conditioner indoor unit according to the present application.
Figure 5:
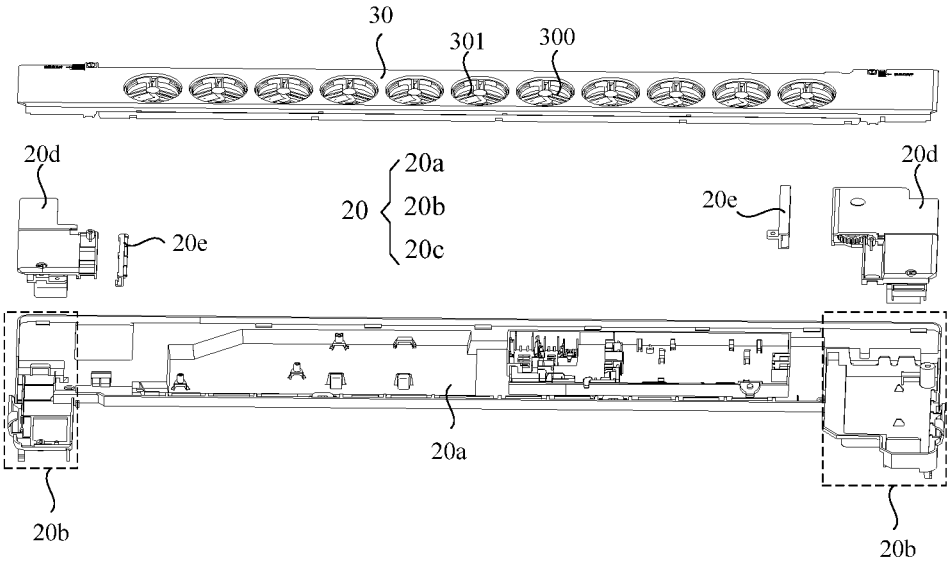
FIG. 5 is a schematic view of a split structure of the drive mechanism and the air blocking assembly in FIG. 4.
Figure 6:
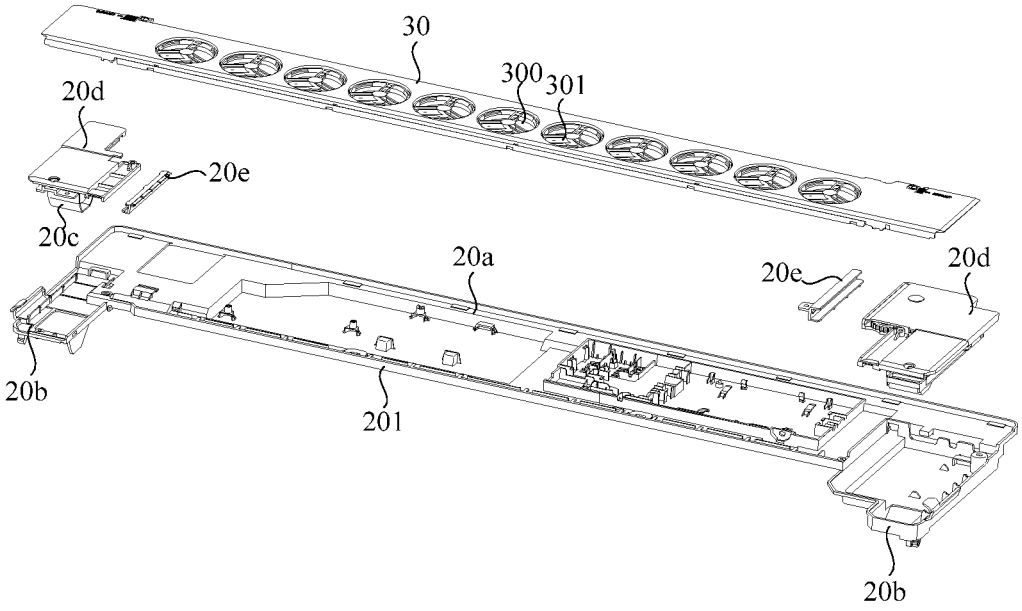
FIG. 6 is another schematic view of FIG. 5.

Referring to FIGS. 4, 5 and 6, the drive mechanism includes a base 20 and a moveable plate 20*d*. The moveable plate 20*d* is mounted on the base 20 and can slide up and down. There are one or two moveable plates 20*d*. The base 20 can be integral (the base 20 can be extended in the length of the panel 10*b*, or its' size can be substantially the same as that of the moveable plate 20*d*), and the base 20 can also include two splits. In this way, the mounting relationship between the moveable plate 20*d* and the base 20 can be that one moveable plate 20*d* is mounted on an integral base 20 (when the base 20 is extended in the length of the panel 10*b*, the moveable plate 20*d* can be mounted in the middle of the base 20; when the size of the base 20 is substantially the same as that of the moveable plate 20*d*, the base 20 can be mounted in the middle of the panel 10*b* or the face frame 10*a*); or two moveable plates 20*d* can be mounted at two ends of an overall base 20 in the length direction respectively, the two moveable plates 20*d* are spaced in the length direction of the panel 10*b*.

The two moveable plates 20*d* are mainly mounted at the two ends of the base 20 in the length direction, which is contemplated as an example for the description below.

Referring to FIG. 7, FIG. 8, FIG. 9 and FIG. 10, the moveable plate 20*d* is provided with a guiding slide 20*f*, which is removably fixed to the moveable plate 20*d*. One end of the guiding slide 20*f* is plugged or clasped to the moveable plate 20*d*, and the other end of the guiding slide 20*f* is fixed to the moveable plate 20*d* by screws (so as to facilitate the installation and removal of the guiding slide 20*f*). The base 20 is provided with a guiding slide groove 224 (FIG. 9 and FIG. 10), and the guiding slide 20*f* is adapted to the guiding slide groove 224, so that the moveable plate 20*d* can slide up and down relative to the base 20 through the cooperation of the guiding slide 20*f* and the guiding slide groove 224. It should be noted that it is not necessary that the drive mechanism in the air conditioner indoor unit is provided with a drive source, i.e., the user can manually operate the air blocking assembly 30 to move up and down. The drive mechanism can be provided with a drive source, such that the drive source is controlled to make the air blocking assembly 30 to automatically move up and down.

Figure 7:
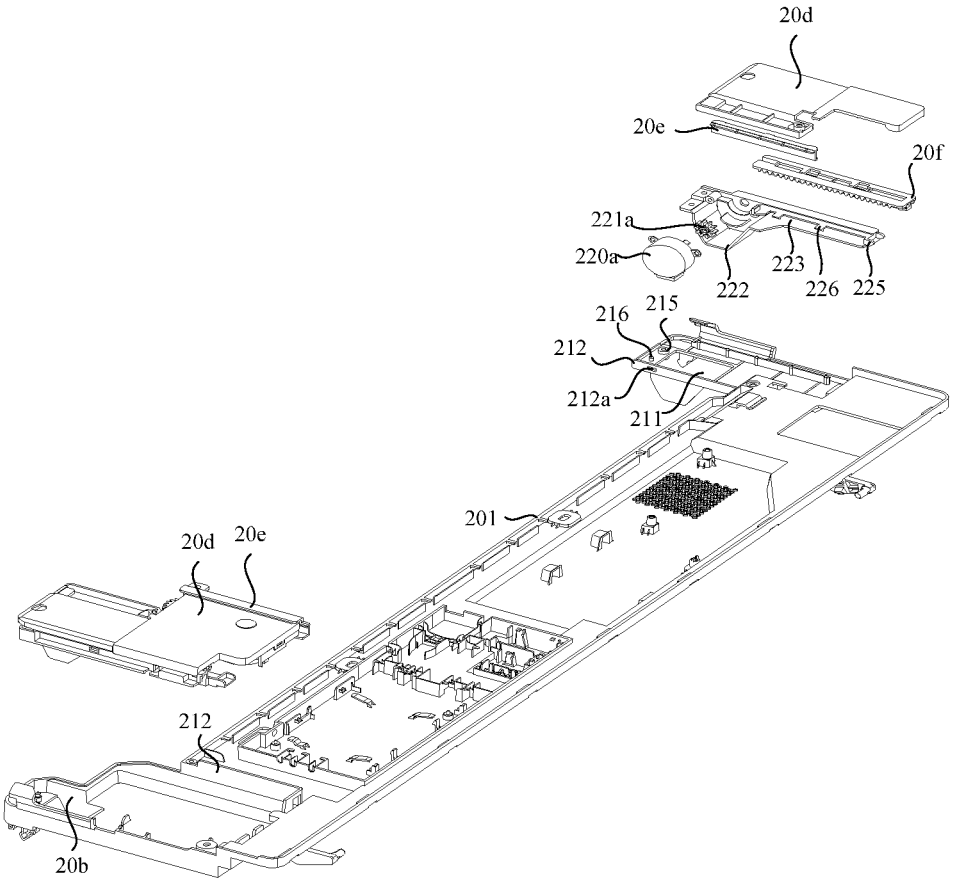
FIG. 7 is an exploded view of FIG. 6.
Figure 8:
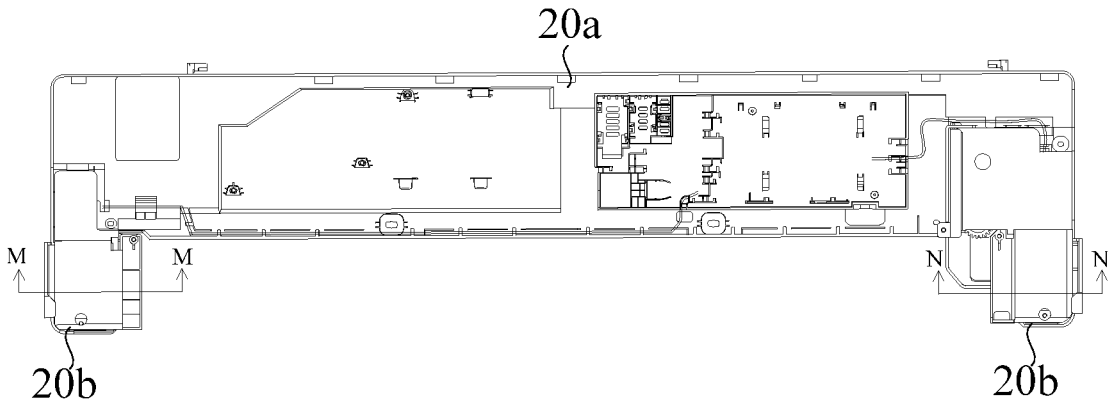
FIG. 8 is a top view after an assembly of the base with a moveable member.
Figure 9:
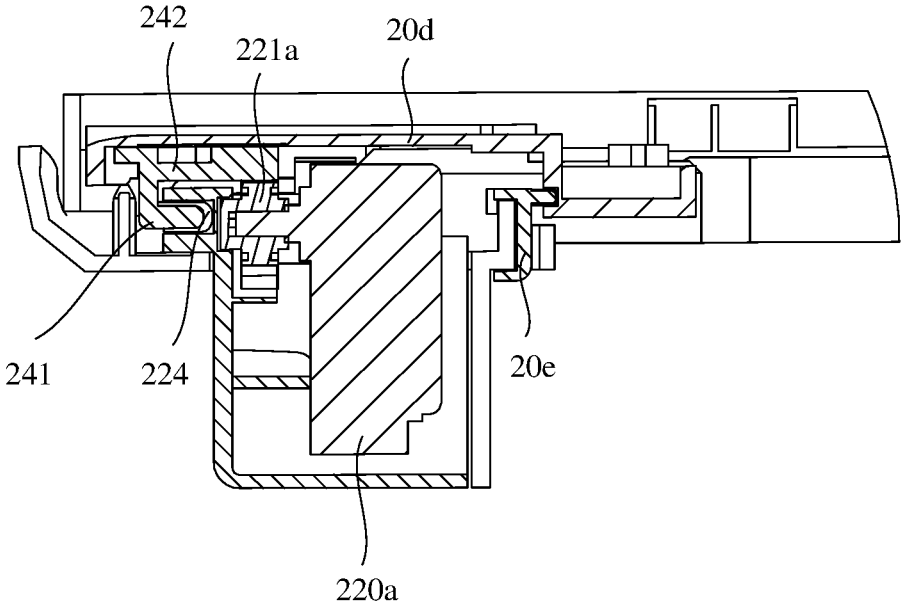
FIG. 9 is a sectional view of FIG. 8 along M-M line.
Figure 10:
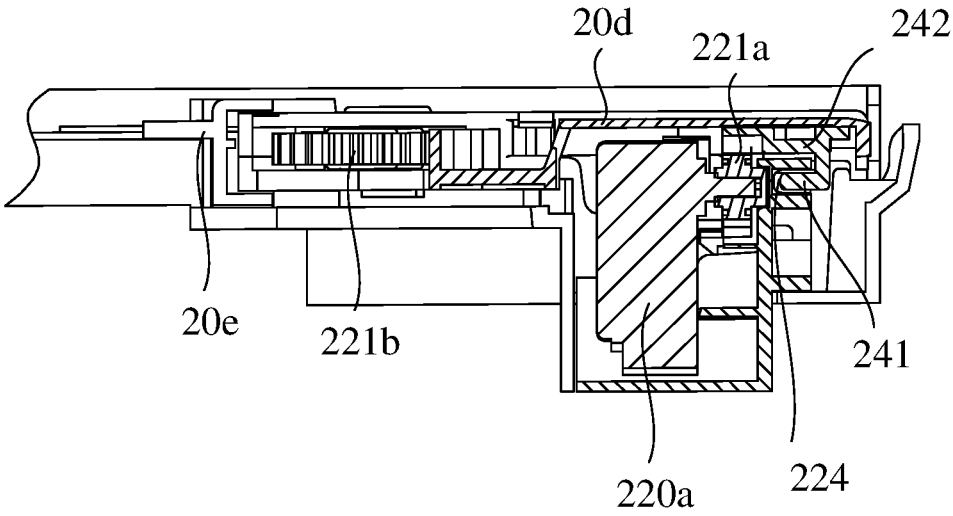
FIG. 10 is a sectional view of FIG. 8 along N-N line.

Referring to FIGS. 6 and 7, the basic structure of the base 20 includes a substrate 20*a* and two franks 20*b*, two flanks 20*b* are provided at two ends of the substrate 20*a* respectively, the substrate 20*a* is provided with a first side edge 201 whose one end extends towards another end, and the two flanks 20*b* protrude from the first side edge 201 (the substrate 20*a* and the flanks 20*b* can be integrally formed or connected by one or more connection members), so that the entire base 20 in the air conditioner indoor unit can be substantially arch-type structure.

Since a space between the panel 10*b* and the face frame 10*a* in the air conditioner indoor unit is limited, and both the air blocking assembly 30 and the substrate 20*a* have a certain thickness. If the substrate 20*a* and the air blocking assembly 30 are mounted between the panel 10*b* and the face frame 10*a* in a laminated manner, it is necessary to leave a large gap between the panel 10*b* and the face frame 10*a* at the beginning of the design, the overall shape of the air conditioner indoor unit will be affected (the air conditioner indoor unit as a whole appears thicker). In addition, the width of the air outlet 101 is generally about 15 cm, so that the width of the air blocking assembly 30 is generally designed based on the width of the air outlet 101, and its width is not much different from that of the air outlet 101, while the width of the entire panel 10*b* is larger, so even if the air blocking assembly 30 is set up with the base 20 in the laminated manner, when the air blocking assembly 30 is accommodated inside the panel 10*b*, the larger space between the panel 10*b* and the face frame 10*a* is not utilized, resulting in a waste of space.

Therefore, after the base 20 is set as an arch-type structure, the air blocking assembly 30 can be set in the middle gap of the arch-type structure, to thus greatly improve the space utilization between the panel 10*b* and the face frame 10*a*.

Figure 11:
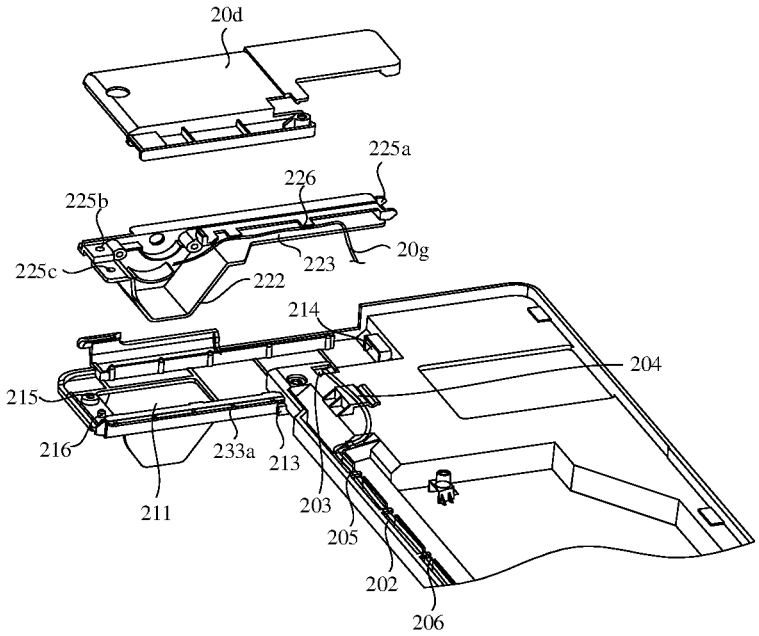
FIG. 11 is a schematic structural view of the base (one of the flanks), the motor box and the moveable plate in FIG. 7 before assembly, in which wires are arranged on both the motor box and the base.
Figure 12:
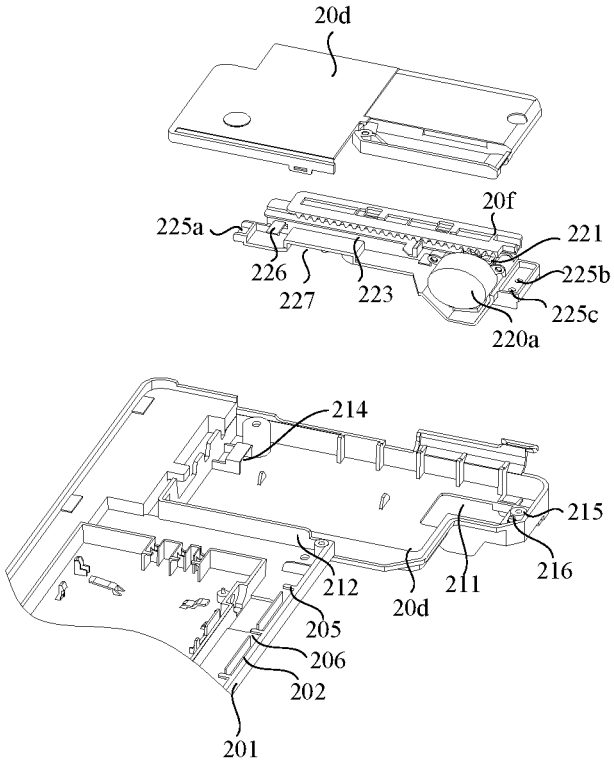
FIG. 12 is a schematic structural view of the base (the other of the flanks), the motor box and the moveable plate in FIG. 7 before assembly.

Referring to FIGS. 11 and 12, the base 20 also includes a motor box 20*c* mounted on the flank 20*b*, and the motor box 20*c* is removably fixed on the flank 20*b*, so that the motor box 20*c* can be mounted and removed more easily. The motor box 20*c* itself is provided with a recessed portion 222 to accommodate the stepper motor 220*a*, the flank 20*b* is provided with a recess 211 to accommodate the recessed portion 222, an insertion hole 214 is provided on the flank 20*b*, a lug 225*a* is provided at one end of the motor box 20*c*, and the other end of the motor box 20*c* is fixed to the flank 20*b* by a connection member. As shown in FIG. 11 and FIG. 12, the other end of the motor box 20*c* is provided with a screw hole 225*b* and a positioning hole 225*c*, and the flank 20*b* is provided with a screw post 215 corresponding to a fixing hole 212*a*, and with a positioning post 216 located near the screw post 215. When the motor box 20*c* is mounted on the flank 20*b*, the lug 225*a* is first inserted into the insertion hole 214, and then the recessed portion 222 is gradually placed in the recess 211, and then the positioning hole 225*c* and the positioning post 216 are inserted, and finally the screw is inserted into the screw hole 225*b* and screwed into the screw post 215, to mount the motor box 20*c*. After the motor box 20*c* is mounted on the flank 20*b*, on the one hand, the two ends of the motor box 20*c* are fixed, and on the other hand, the motor box 20*c* is mounted more stably on the flank 20*b* due to the adaptation of the recess 211 and the recessed portion 222.

Referring to FIG. 7, FIG. 11 and FIG. 12, a stepper motor 220*a* and a first gear 221*a* are mounted in the motor box 20*c*, the stepper motor 220*a* is fixed in the recessed portion 222 of the motor box 20*c* by screws, and the first gear 221*a* is mounted on the motor shaft of the stepper motor 220*a*. The motor box 20*c* is provided with a first wire groove 223, the lug 225*a* of the motor box 20*c* and insertion holes 214 is located in the extension direction of the first wire groove 223, an opening of the first wire groove 223 is provided with a first wire clamping 226, the wire 20*g* connected to the stepper motor 220*a* is penetrated into the first wire groove 223, and the wire 20*g* in the first wire groove 223 is not easy to get out under the limitation of the first wire clamping 226.

Figure 13:
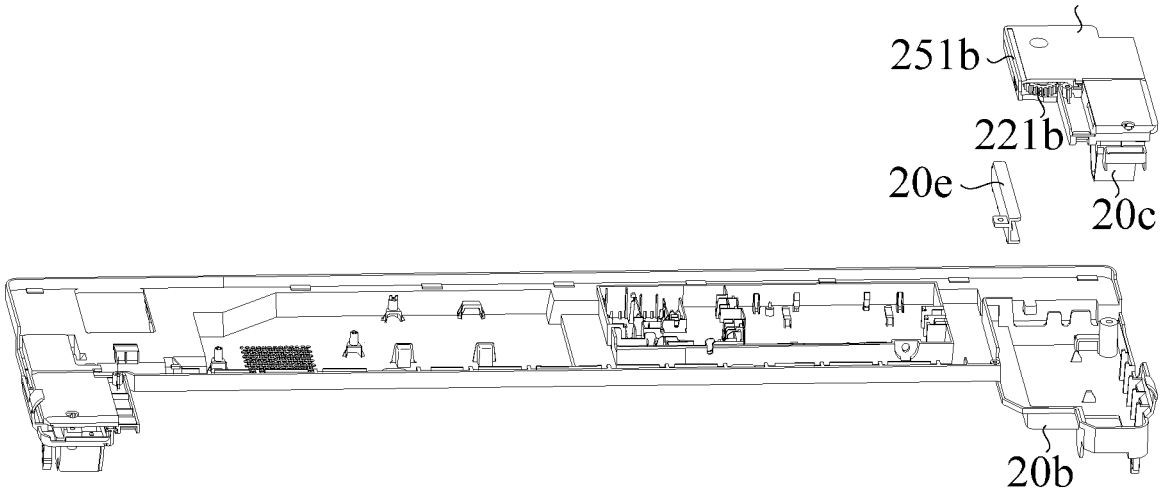
FIG. 13 is a schematic structural view of the base (with a rectifying guide rail), the motor box and the moveable plate in FIG. 7 before assembly.

The panel 10*b* can be set up with a display module for displaying such as the target temperature, air conditioning operation mode, humidity and other parameters. The display module and the drive mechanism are located inside the panel 10*b*, referring to FIG. 13. In order to improve the assembly efficiency of the air conditioning indoor unit, the display module (no display module is mounted in the figure) can be integrated into the base 20, and the wire 20*g* connected to the stepper motor 220*a* can be connected to the display module, and then connected to the electronic control box. The flank 20*b* is at a certain distance from the display module. Referring to FIG. 11 and FIG. 12, in order to avoid the wire 20*g* connected to the stepper motor 220*a* to be exposed after being led out from the first wire groove 223, in one embodiment, the substrate 20*a* is provided with a second wire groove 202, the second wire groove 202 extends from the flank 20*b* towards the display box, the wire 20*g* is led out from the first wire groove 223 and then enters into the second wire groove 202, and then into the display box. Because the first wire groove 223 is extended in an up and down direction, the second wire groove 202 is extended in a left and right direction, if the wire 20*g* is led out from the first wire groove 223 and directly enters into the second wire groove 202, due to the influence of the second wire groove 202, the wire 20*g* in the first wire groove 223 will be shifted towards the second wire groove 202, and if influenced for a long time, the wire 20*g* maybe come out of the first wire groove 223, and then to cause the wire 20*g* to come out of the second wire groove 202. In view of this, in one embodiment, the substrate 20*a* is provided with a wire hole 203, which is located between the first wire groove 223 and the second wire groove 202, such that the wire hole 203 is closer to the first wire groove 223, which can slow down the deviation of the wire 20*g* coming out of the first wire groove 223. Further, since there is a certain distance between the wire hole 203 and the first wire groove 223, if the distance is overly long, it will cause the wire 20*g* to be lengthy, and the lengthy wire 20*g* between the wire hole 203 and the second wire groove 202 will fall down, and may eventually fall down to a gap of the arch-type base 20, to interfere with the up and down sliding of the air blocking assembly 30, and even to cause security accident. On the other hand, the wire 20*g* may also fall from below the panel 10*b* to the air outlet 101, thus seriously affecting the user experience. In order to avoid this situation, in another embodiment, the substrate 20*a* is also provided with a pressing wire plate 204, which is located between the wire hole 203 and the second wire groove 202, and the lower end of the pressing wire plate 204 is connected to the substrate 20*a* and extends upward. The pressing wire plate 204 not only can press the wire 20*g* on the substrate 20*a*, but also can bear the wire 20*g*, even if the wire 20*g* is slightly long, it will not fall to the gap in the base 20.

The second wire groove 202 aims to accommodate and hide the wire 20*g*. In an embodiment, in order to facilitate the installation of the wire 20*g* in the second wire groove 202, the opening of the second wire groove 202 faces the panel 10*b*, and the opening of the second wire groove 202 is provided with a second wire clamping 205. The second wire groove 202 is provided with two side walls extending in the left and right direction, and the second wire clamping 205 is connected to one of the two side walls, the other of the two side walls corresponding to the second wire clamping 205 is provided with an avoidance gap 206. When arrangement of wire, the wire bypasses the second wire clamping 205 due to the avoidance gap 206, so that it is convenient to either arrange wire or remove the wire 20*g* from the second wire groove 202.

In the two flanks 20*b* of the base 20, the opening of the first wire groove 223 on one of the two flanks 20*b* faces the other of the two flanks 20*b*, so that it is easy to hide the wire 20*g*, and the user cannot see the wire 20*g* when observing the base 20 either from the front side or from the rear side.

In addition, the motor box 20*c* slidingly cooperates with the guiding slide 20*f*, and the motor box 20*c* is provided with the guiding slide groove 224, and the opening direction of the guiding slide groove 224 is opposite to the opening direction of the first wire groove 223, because the opening of guiding slide groove 224 is towards its' side (in the air conditioning indoor unit, the opening of the guiding slide groove 224 is towards the left or right), so that the guiding slide groove 224 can limit the displacement of the guiding slide 20*f* forward or backward. Since both the guiding slide 20*f* and the guiding slide groove 224 extend in the up and down direction, the guiding slide 20*f* can only slide up and down in the guiding slide groove 224 after the guiding slide 20*f* cooperates with the guiding slide groove 224.

Figure 18:
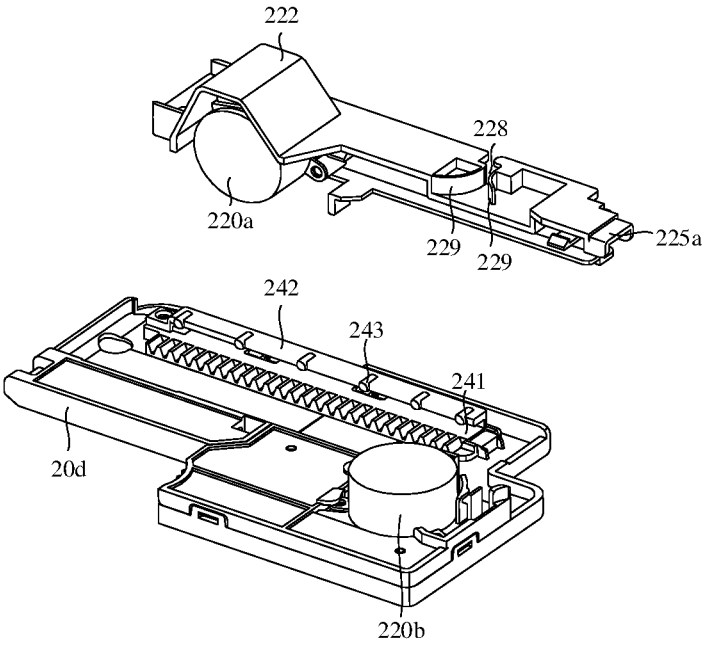
FIG. 18 is another schematic view of an assembly of the moveable plate and the motor box in FIG. 17.

Referring to FIGS. 7 to 10, the guiding slide 20*f* is provided with a rack, which engages with a first gear 221*a*, and the stepper motor 220*a* when working can drive the guiding slide 20*f* to move up and down through the first gear 221*a*. Referring to FIG. 18, the guiding slide 20*f* includes a rack plate 241 and a track plate 242, there is a gap between the rack plate 241 and the track plate 242, the rack plate 241 is provided with a rack that engages with the first gear 221*a*, and the track plate 242 is inserted into the guiding slide groove 224. In order to reduce the sliding cooperation resistance of the guiding slide 20*f* with the guiding slide groove 224, the track plate 242 is provided with a plurality of first column 243, not only the side wall of the first column 243 protrudes from one side of the track plate 242, but also the other side wall of the first column 243 protrudes from the other side of the track plate 242, so that when the track plate 242 is inserted into the guiding slide groove 224, the side wall of the first column 243 is abutted against the inner wall of the guiding slide groove 224. As a result, the friction is less and the sliding between the guiding slide 20*f* and the guiding slide groove 224 is smoother.

The method of the moveable plate 20*d* moving up and down can be that one guiding slide 20*f* cooperates with one guiding slide groove 224 or two guiding slides 20*f* cooperate with two guiding slide grooves 224. Considering that the panel 10*b* of the wall-mounted air conditioner indoor unit extends in the left and right direction, in order to make the air blocking assembly 30 slide more smoothly, it is desirable to provide the guiding slide 20*f* on each moveable plate 20*d*, and provide the guiding slide groove 224 on each flank 20*b*. In addition, the two flanks 20*b* are also provided with the sliding drive assembly.

Figure 14:
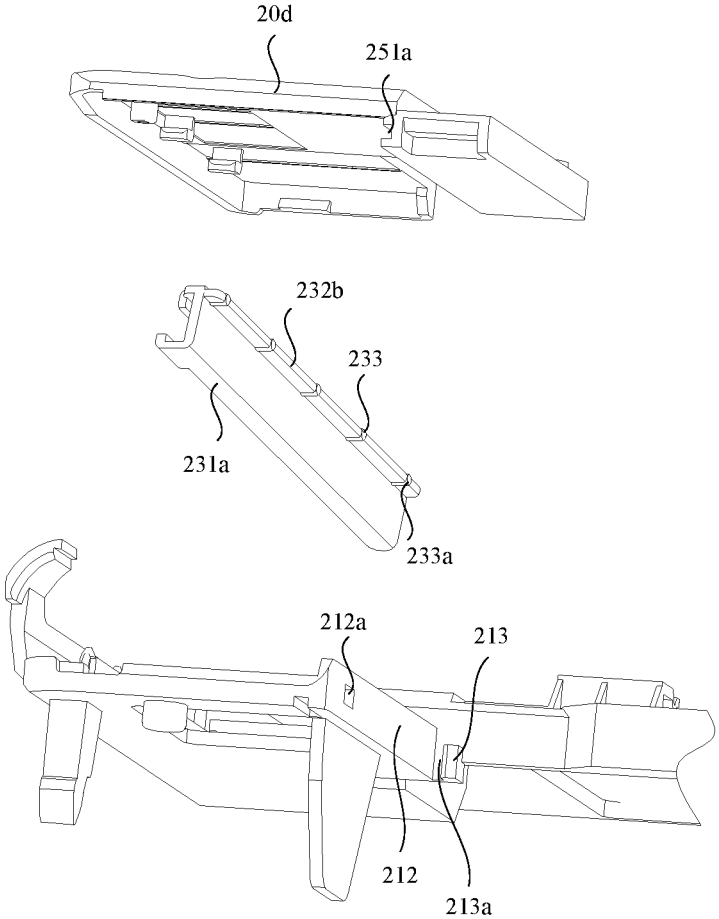
FIG. 14 is another schematic structural view of the flanks, the moveable plate and the rectifying guide rail in FIG. 11 before assembly.
Figure 15:
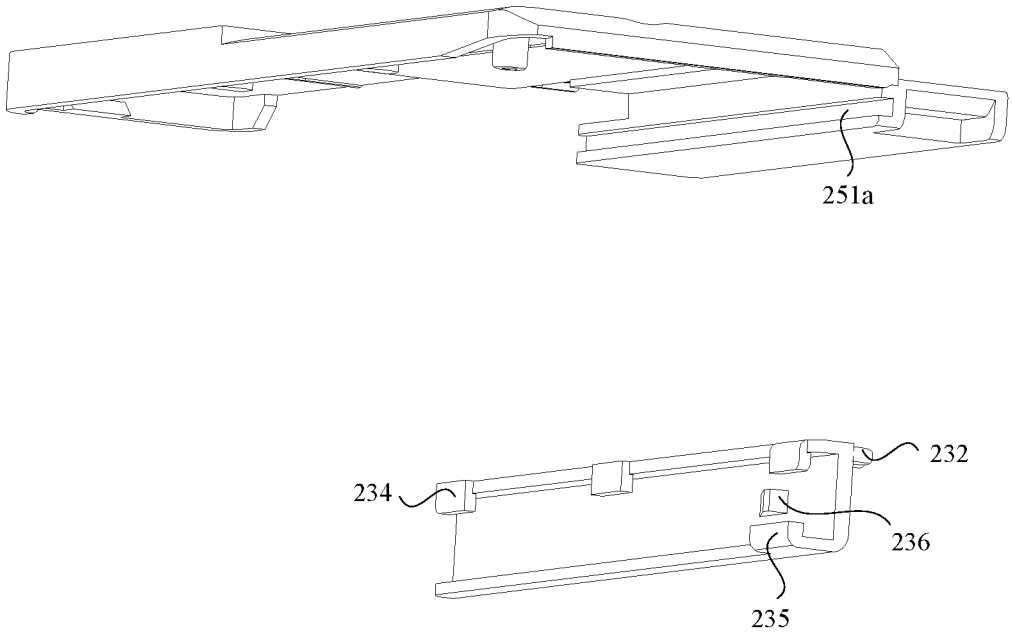
FIG. 15 is a yet schematic structural view of the moveable plate and the rectifying guide rail in FIG. 14 before assembly.
Figure 16:
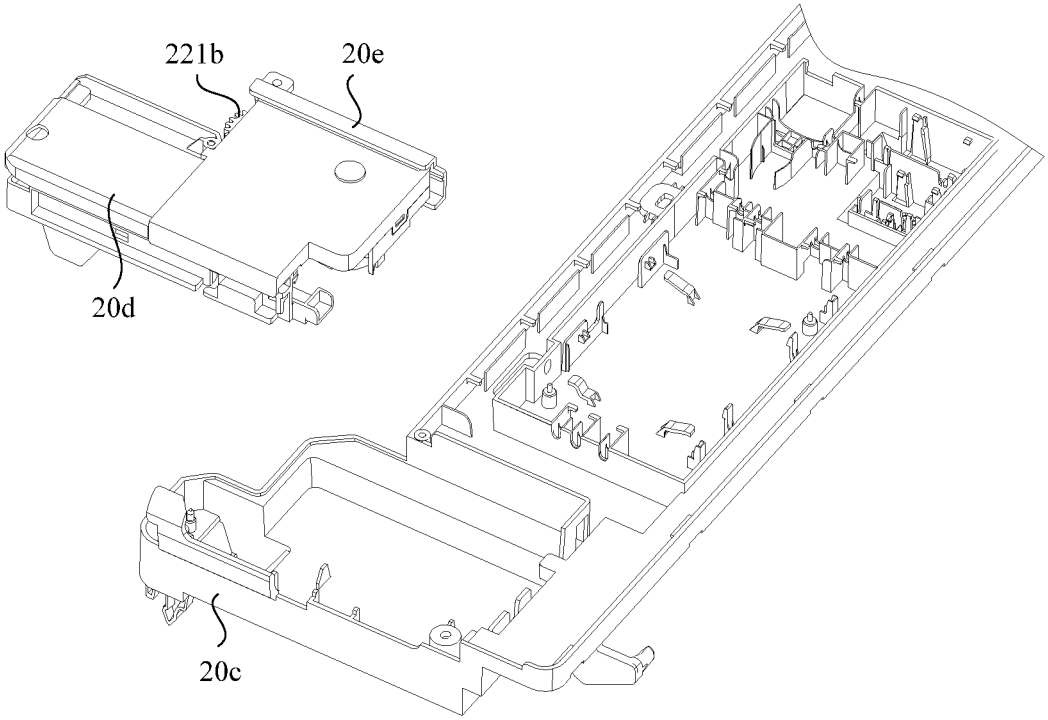
FIG. 16 is a partially enlarged view of FIG. 7.

Referring to FIG. 6, FIG. 14 and FIG. 15, in order to make the air blocking assembly 30 slide more smoothly, in one embodiment, a rectifying guide rail 20*e* is provided on the base 20, and the moveable plate 20*d* is provided with a guiding groove 251*a* adapted to slide with the rectifying guide rail 20*e*. There is one or two rectifying guide rails 20*e*. The main function of the rectifying guide rail 20*e* is to improve the stability of the sliding of the single moveable plate 20*d*. The rectifying guide rail 20*e* is extended in the up and down direction, and the rectifying guide rail 20*e* is spaced from the guiding slide 20*f*. For the embodiment where only one rectifying guide rail 20*e* is mounted on the base 20, the rectifying guide rail 20*e* can be mounted at various positions, for example, one of the guiding slide 20*f* is located between the rectifying guide rail 20*e* and the other of the guiding slide 20*f*, or it can be that the rectifying guide rail 20*e* is located between two guiding slide 20*f*. For the embodiment where two rectifying guide rail 20*e* are mounted on the base 20, there are also various ways to mount the rectifying guide rail 20*e*, such as two rectifying guide rail 20*e* are located between two guiding slides 20*f*, or the rectifying guide rail 20*e* and the guiding slide 20*f* can be alternately arranged, or the two guiding slide 20*f* is located between the two rectifying guide rail 20*e*.

The following describes the installation of the rectifying guide rail 20*e*.

Considering that when the air blocking assembly is connected to the moveable plate 20*d*, it is mainly connected to the inner side of the moveable plate 20*d* (near the gap in the middle of the arch-type base 20). Thus, the inner side of the moveable plate 20*d* needs to bear the gravity of the air blocking assembly 30, while the outer side of the moveable plate 20*d* forms a tendency to incline inward.

The air blocking assembly 30 is extended in the length of the panel 10*b* (the air blocking assembly 30 is used to cover the air outlet 101, which is extended in the left and right direction), and the air blocking assembly 30 is longer (about 0.6 m~1 m), and there is a certain tolerance for the installation of such a length of the air blocking assembly 30 on the moveable plate 20*d*, and in addition the base 20 and the moveable plate 20*d* are made of plastic, so when the moveable plate 20*d* moves in the up and down direction, once the travel of the two ends of the air blocking assembly 30 is not consistent (one end is high and one end is low), it will cause the moveable plate 20*d* to jam and the air blocking assembly 30 will not be able to move up and down.

On the one hand, the rectifying guide rail 20*e* provides more tracks for the movement of the air blocking assembly 30, so that the air blocking assembly 30 moves more smoothly; on the other hand, after the combination of the guiding slide 20*f* and the rectifying guide rail 20*e*, when the moveable plate 20*d* slides up and down, the guiding slide 20*f* and the rectifying guide rail 20*e* limit each other, so that the left and right swing of the moveable plate 20*d* when moving can be reduced, which in turn reduces inconsistent of the travel of the two ends of the air blocking assembly 30 when the air blocking assembly 30 moves up and down.

Since the connection position between the air blocking assembly 30 and the moveable plate 20*d* is biased toward the inner side edge of the moveable plate 20*d*, in one embodiment, referring to FIG. 6, FIG. 14, FIG. 16, and FIG. 17, in order to make the rectifying guide rail 20*e* more effective, the rectifying guide rail 20*e* is mounted on the inner side edge of the flank 20*b* (FIG. 14 and FIG. 16), and it should be noted that the flank 20*b* is provided with an outer side edge away from the substrate 20*a* and an inner side edge opposite to the outer side edge. The flank 20*b* in the figure is integrally formed with the substrate 20*a*, a part of the inner side edge of the flank 20*b* is overlapped with the substrate 20*a*, this part of the inner side edge is at the junction of the flank 20*b* and the base (for ease of presentation, this inner side edge is defined as $X_1$), and another part of the inner side edge of the flank 20*b* protrudes from the first side edge 201 (this inner side edge is defined as $X_2$), and the rectifying guide rail 20*e* can be mounted anywhere on the inner side edge of the flank 20*b*, as long as it can cooperate with the sliding of the moveable plate 20*d*. For the embodiment where two flanks 20*b* cooperate with the rectifying guide rail 20*e*, one of the rectifying guide rail 20*e* can be mounted at $X_1$ or at $X_2$, and two rectifying guide rails 20*e* are mounted at $X_1$ or at $X_2$. In order to make the overall operation of the moveable plate 20*d* smoother, the two rectifying guide rails 20*e* are staggered in a direction perpendicular to a sliding direction of the moveable plate 20*d* (i.e. one of two rectifying guide rails 20*e* is mounted at $X_1$ and the other of two rectifying guide rails 20*e* at $X_2$). With this setup, the two rectifying guide rails 20*e* are supported inclinedly and mutually by the air blocking assembly 30, and in addition, with the guidance of the two guiding slide 20*f*, two moveable plates 20*d* slide more smoothly. This arrangement of the two rectifying guide rails 20*e* makes the connection line of the midpoint of the two rectifying guide rails 20*e*, the extension direction of the rectifying guide rail 20*e*, and the two moveable plates 20*d* to form a triangle, thus the stability is improved.

In order to facilitate the assembly and fixation of the rectifying guide rail 20*e*, in one embodiment, the inner side of the flank 20*b* is formed with edge plates 212, 212' (FIG. 7, FIG. 12 and FIG. 14), and the rectifying guide rail 20*e* is clasped to the edge plate 212. The rectifying guide rail 20*e* includes a rectifying slide groove 231*a* and a rectifying rib 232*a* provided in the rectifying slide groove 231*a*, and the rectifying slide groove 231*a* is socketed with the edge plate 212 (the rectifying slide groove 231*a* can slide up and down in the edge plate 212 before being fixed to the flank 20*b*), and the moveable plate 20*d* is provided with a guiding groove 251*a*, and the guiding groove 251*a* slidingly cooperates with the rectifying rib 232*a*, and on the same flank 20*b*, the opening of the rectifying slide groove 231*a* faces the guiding slide 20*f* located on the flank 20*b*, and the rectifying rib 232*a* is located on the side of the guiding slide 20*f* of the flank 20*b* away from the rectifying slide groove 231*a*. In this way, the guiding groove 251*a* can clamp with the rectifying rib 232*a* for limitation in the front-to-back direction.

In addition, in order to facilitate removal and installation of the rectifying slide groove 231*a*, the rectifying slide groove 231*a* may be fixed to the flank 20*b* in a removeable manner. In one embodiment, the edge plate 212 is provided with a fixing hole 212*a*, and the inner wall of the rectifying slide groove 231*a* is provided with a clamping table 236 corresponding the fixing hole 212*a*. In such a way, when mounting the rectifying guide rail 20*e*, after the clamping table 236 is clamped into the fixing hole 212*a*, the rectifying slide groove 231*a* can be fixed on the edge plate 212 (in the up and down direction, the rectifying slide groove 231*a* can be kept relatively fixed with the edge plate 212). In order to make the installation of the rectifying guide rail 20*e* more stable, the flank 20*b* is provided with a first fixing groove 212*b* (located at the lower end of the flank 20*b*, in the shape of a gap) located on the inner side of the edge plate 212; and the rectifying slide groove 231*a* is provided with two side edges extending in the sliding direction of the edge plate 212, one side edge is provided with a first clasp table 234 for clasping the edge plate 212, and the other side edge is provided with a second clasp table 235 for cooperating with the first fixing groove 212*b*. In this way, the first clasp table 234 can clasp one side of the edge plate 212 to keep one side wall of the rectifying slide groove 231*a* fixed relative to the edge plate 212, and the second clasp table 235 can fix the other side wall of the rectifying slide groove 231*a* to the edge plate 212. Further, referring to FIG. 14, the first side edge 201 of the substrate 20*a* is provided with a stop portion

213, and a second fixing groove 213*a* is formed between the stop portion 213 and the edge plate 212, and the rectifying slide groove 231*a* is inserted into the second fixing groove 213*a*. In order to facilitate the assembly of the rectifying guide rail 20*e*, the clamping table 236 and the second clasp table 235 are provided at the end of the rectifying slide groove 231*a* away from the substrate 20*a*.

Further, referring to FIG. 15, in order to facilitate the installation and removal of the rectifying slide groove 231*a*, the clamping table 236 is of triangular shape, that is, when the upper port of the rectifying slide groove 231*a* is aligned with the lower end of the edge plate 212, the rectifying slide groove 231*a* is pushed upward and the first clasp table 234 is clasped with a side of the edge plate 212, and when the clamping table 236 is abutted against the lower end of the edge plate 212, the rectifying slide groove 231*a* continues to be pushed upward with force, and at this time, because the clamping table 236 is of triangular shape, one side of the clamping table 236 is sloping surface, and under the guiding of the sloping surface, the clamping table 236 gradually crosses the lower end of the edge plate 212, and the edge plate 212 and/or the rectifying guide rail 20*e* deforms under the action of the clamping table 236 abutting against the edge plate 212, until the clamping table 236 is clasped into the fixing hole 212*a*, the edge plate 212 and/or the rectifying guide rail 20*e* restore, so that the bottom of the rectifying slide groove 231*a* can be firmly attached to the edge plate 212. In summary, the rectifying slide groove 231*a* is firmly fixed to the edge plate 212 by the rectifying slide groove with four fixing methods (the upper end of the rectifying slide groove 231*a* is inserted in the second fixing groove 213*a*, the first clasp table 234 is clasped with the edge plate 212, the second clasp table 235 is clasped with the first fixing groove 212*b*, and the clamping table 236 is inserted into the fixing hole 212*a*).

Referring further to FIGS. 14 and 15, the rectifying rib 232*a* is approximately flush with one side of the rectifying slide groove 231*a*, and the rectifying rib 232*a* is inserted into the guiding groove 251*a*. To reduce the friction between the rectifying rib 232*a* and the inner wall of the guiding groove 251*a*, a plurality of second columns 233 are provided on the rectifying rib 232*a*, that is, the guiding groove 251*a* is provided with two opposite side walls, and each side of the rectifying rib 232*a* is provided with at least two curved protrusions 233*a* (the curved protrusions 233*a* are the side walls of the second column 233), and the curved protrusions 233*a* located on each side of the rectifying guide rail 20*e* correspond to each of two side walls of the guiding groove 251*a*.

The structure can be the same or different for the two rectifying guide rails 20*e*. In another embodiment, referring to FIGS. 16 and 17, the rectifying guide rail 20*e* includes a rectifying slide groove 231*b*, and the moveable plate 20*d* is provided with a guiding portion 251*b*, which is provided on the inner side of the flank 20*b* (roughly located at the junction of the flank 20*b* with the substrate 20*a*, no obvious junction line between the substrate 20*a* and the flank 20*b*, and they maybe integral or assembled), the guiding portion 251*b* is slidably provided within the rectifying slide groove 231*b*.

Figure 17:
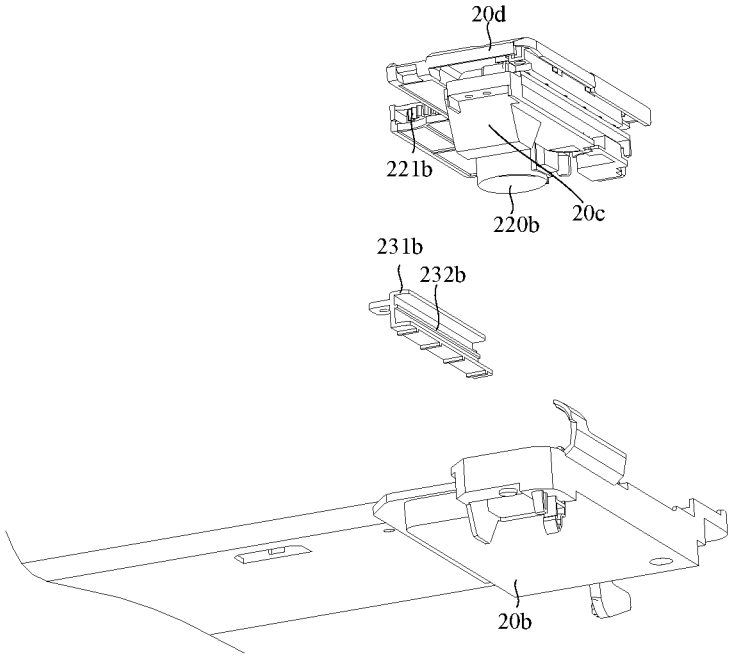
FIG. 17 is a schematic view of an assembly of the flanks, the rectifying guide rail, the motor box, and the moveable plate in FIG. 16

Referring to FIG. 17, in order to further reduce the friction resistance between the rectifying slide groove 231*b* and the guiding portion 251*b*, the rectifying guide rail 20*e* also includes a rectifying rib 232*b* provided on the inner wall of the rectifying slide groove 231*b*, and the rectifying rib 232*b* is abutted against the guiding portion 251*b*, and the rectifying rib 232*b* is extended in the up and down direction, and its' the contact area with the guiding portion 251*b* is smaller and the sliding is smoother.

Since the rectifying guide rail 20*e* needs to secure the sliding track of the moveable plate 20*d*, the rectifying guide rail 20*e* can be made of the rigid material, such as stainless steel, aluminum alloy, etc. In addition, since the rectifying guide rail 20*e* slides in the guiding groove 251*a* for a long time, the rectifying guide rail 20*e* can be made of the self-lubricating wear-resistant material in order to make the sliding of the rectifying guide rail 20*e* smoother.

When the air blocking assembly 30 is a cyclone module, the fan blade 301 provided in the air blocking assembly 30 can be made to rotate by active driving. In one embodiment, one of the moveable plates 20*d* is also provided with a fan blade 301 driving assembly, and the fan blade 301 driving assembly is connected to the fan blade 301 for driving the fan blade 301 to rotate. The fan blade 301 driving assembly includes a drive motor 220*b* and a second gear 221*b*, and the second gear 221*b* is connected to the fan blade 301 by transmission.

Referring to FIG. 11, FIG. 12 and FIG. 18, the moveable plate 20*d* moves up and down, and the fan blade 301 driving assembly moves with the moveable plate 20*d*, and the motor wire 20*g* connected to the drive motor 220*b* needs to move together, so the motor wire 20*g* needs to be redundant to a certain length. The base 20 is provided with a wire through groove 227 for wiring the motor wire 20*g*, and the motor wire 20*g* enters into the wire through groove 227 through the wire inlet 228 of the wire through groove 227, and then connected to the display box. Since the line of defense at opening of the wire inlet 228 is roughly at 90° to the up and down direction, the redundant motor wire 20*g* is easily bent by a large angle during movement after being led out from the wire inlet 228. In the long term, the motor wire 20*g* is prone to fatigue and thus be damaged. The operation of the air blocking assembly 30 is affected, and the service life of the air conditioning indoor unit is reduced, and the safety accidents easily occurs.

In addition, the closer the distance between the wire through groove 227 and the drive motor 220*b*, the motor wire 20*g* located therebetween is more likely to bend by a large angle, so that the wire through groove 227 and the drive motor 220*b* in the length direction of the panel 10*b* should be kept apart, the longer the distance, the motor wire 20*g* is less likely to bend by a large angle.

Figure 19:
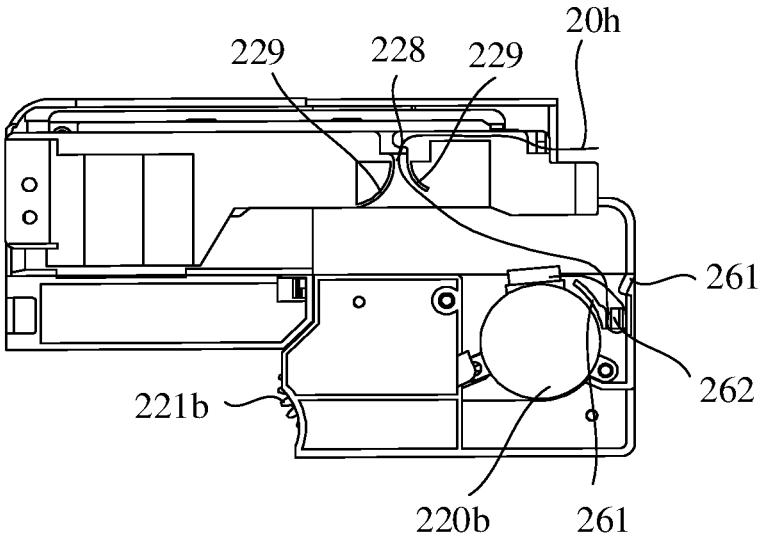
FIG. 19 is a top view of the back side after the assembly of the moveable plate and the flanks in FIG. 17, in which the moveable plate is in the highest position.
Figure 20:
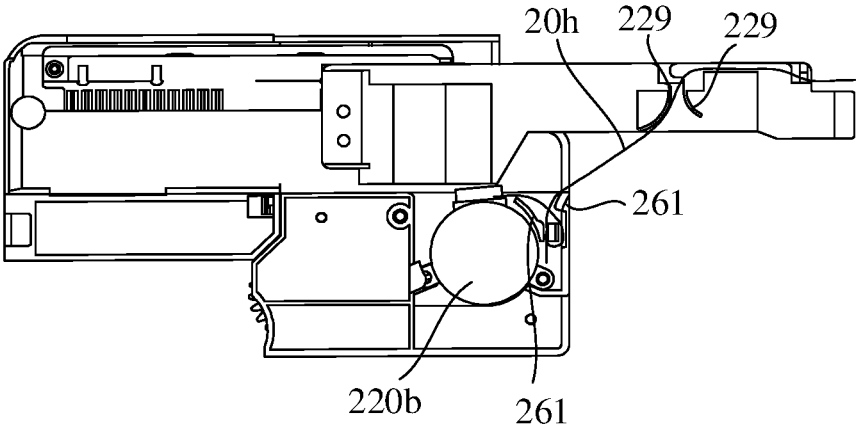
FIG. 20 is a top view of the back side after the assembly of the moveable plate and the flanks in FIG. 17, in which the moveable plate is located in the lowest position
Figure 21:
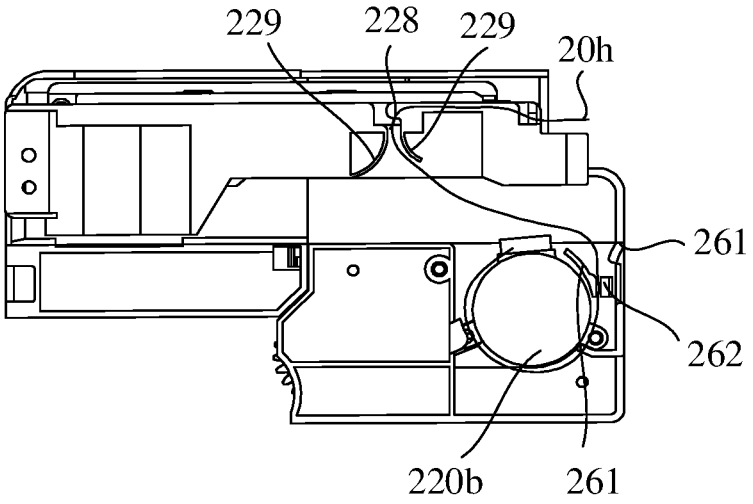
FIG. 21 is a top view of the back side after the assembly of the moveable plate and the flanks in FIG. 17, in which the moveable plate is located at the highest position and the motor wire winds at the periphery of the drive motor.

In one embodiment, referring to FIGS. 19 to 21, in order to avoid large angle bending of the lengthy motor wire 20*g*, a first guiding portion 229 is provided at the wire inlet 228 of the wire through groove 227, and the first guiding portion 229 may extend upward inclined or downward inclined from the wire inlet 228, and the inclined extension may be straight inclined extension, or an arc inclined extension. If the first guiding portion 229 extends inclinedly and downward from the wire inlet 228, then the first guiding portion 229 will have a certain load-bearing force on the motor wire 20*g* when the moveable plate 20*d* moves downward, and can also reduce the bending angle of the motor wire 20*g* at the end of the first guiding portion 229. If the first guiding portion 229 is extended inclinedly and upward from the wire inlet 228, then when the moveable plate 20*d* moves upward, and after the motor wire 20*g* is led out from the wire inlet 228 under the action of the first guiding portion 229, the motor wire 20*g* will not bend excessively under the guidance of the first guiding portion 229, and the action of the gravity of the motor wire 20*g*.

If there is only one first guiding portion 229, a better way to set the first guiding portion 229 is to extend the first guiding portion 229 inclinedly and downward from the wire inlet 228.

Considering that a single first guiding portion 229 is not as effective as two first guiding portions 229, in one embodiment, two first guiding portions 229 are provided at the wire inlet 228, one first guiding portion 229 bends downward from the wire inlet 228 and the other first guiding portion 229 bends upward from the wire inlet 228. In this way, whether the moveable plate 20*d* moves upward or downward, the first guiding portion 229 can guide the lengthy motor, thus avoiding a large bending angle of the motor wire 20*g*.

In addition, the length of the first guiding portion 229 extending downward from the wire inlet 228 is defined as s1, and the length of the first guiding portion 229 extending upward from the wire inlet 228 is defined as s2, s1 is greater than s2, because the motor wire 20*g* is subject to its own action when moving, and the motor wire 20*g* is more likely to bend by a large angle when it comes into contact with the end of the first guiding portion 229 that extends downward, so that if the length of the first guiding portion 229 is lengthened, the end tangent of the first guiding portion 229 may coincide (or substantially coincide) with the extension direction of the motor wire 20*g*, so that the wire 20*g* extends more smoothly after passing through the first guiding portion 229.

In another embodiment, for better guidance of the two first guiding portions 229, a gap is formed between the two first guiding portions 229, and the gap is set in a flared manner in a direction away from the wire inlet 228. The two first guiding portions 229 are set in an arc shape, and the gap therebetween is set in a flared manner, so that the tangential angle of the two first guiding portions 229 also becomes larger in the direction away from the wire inlet 228, thus reducing the large angle bend of the motor wire 20*g*.

The large angle bend of the motor wire 20*g* depends not only on the position of the wire inlet 228, but also on the angle of the wire coming out of the drive motor 220*b*. In one embodiment, the moveable plate 20*d* is provided with a second guiding portion 261, which is located at the periphery of the drive motor 220*b*, and the second guiding portion 261 extends toward a side where the wire through groove 227 is located and inclines downward, or the second guiding portion 261 extends toward a side where the wire through groove 227 is located and inclines upward.

Similar to the first guiding portion 229, there are two second guiding portions 261, that is, two second guiding portions 261 are provided on the moveable plate 20*d*, and the two second guiding portions 261 are spaced, one of the second guiding portions 261 bends downward and the other second guiding portion 261 bends upward. The bending effect of the second guiding portion 261 can be referred to the first guiding portion 229.

In addition, since the motor wire 20*g* can be soldered to the interface of the motor, if the motor wire 20*g* is subjected to a pulling force at the interface where the motor is connected to the motor, it is easy to cause a loose solder joint at the interface, poor contact of the drive motor 220*b*, and in severe cases, a direct disengagement of the motor wire 20*g* from the motor. In view of this, in an embodiment, a wire-winding portion 262 is provided between the two second guiding portions 261, and the wire-winding portion 262 is spaced from the two second guiding portions 261. After the wire-winding portion 262 is provided, the motor wire 20*g* can be wound on the wire-winding portion 262, and even if it is subjected to a pulling force, the motor wire 20*g* can disperse most of the pulling force to the wire-winding portion 262, thereby avoiding loosening of the solder joint of the motor wire 20*g* and the motor interface.

There are various ways to route the motor wire 20*g* between the two second guiding portions 261, for example, a first gap is provided between the wire-winding portion 262 and one of the second guiding portions 261 near the drive motor 220*b*, and a second gap is provided between the wire-winding portion 262 and the other second guiding portion 261. After being led out from the drive motor 220*b*, the motor wire 20*g* first passes through the first gap, then passes through the second gap, and then enters into the wire inlet 228 from the gap between two first guiding portions 229, i.e., the motor wire 20*g* connected to the drive motor 220*b* is wound around the periphery of the wire-winding portion 262 and passes through the gap between the two first guiding portions 229 into the wire through groove 227. For this kind of winding for a week, if the motor wire 20*g* suddenly receives a large pulling force when the moveable plate 20*d* moves up and down, the pulling force can be transferred almost entirely to the wire-winding portion 262 in a flash, so that the wire-winding portion 262 provides excellent protection for the connection of the motor wire 20*g*.

In the embodiment without the wire-winding portion 262, the motor wire 20*g* is wound around the periphery of the drive motor 220*b* after being led out from the motor, and passes through the gap between the two second guiding portions 261 and the gap between the two first guiding portions 229 into the wire through groove 227, i.e., the outer wall of the drive motor 220*b* replaces the role played by the wire-winding portion 262. When the motor wire 20*g* is subjected to a sudden pulling force, the pulling force can be instantaneously counteracted by the friction force between the drive motor 220*b* and the motor wire 20*g*, thus protecting the connection of the motor wire 20*g*.

The moveable plate 20*d* has two extreme positions of moving to the uppermost and the lowermost, and the travel between the two extreme positions is a maximum travel of the moveable plate 20*d*. The length of the redundant motor wire 20*g* between the wire inlet 228 and the wire-winding portion 262 must be always greater than the straight distance between the wire inlet 228 and the wire-winding portion 262, otherwise the motor wire 20*g* will be subjected to severe pulling force during the movement of the moveable plate 20*d* up and down. In addition, the redundant motor wire 20*g* between the wire inlet 228 and the wire-winding portion 262 should not be overly long, because long motor wire 20*g* will be tangled and knotted from the wire inlet 228 to the wire-winding portion 262, thus the motor wire 20*g* is easy to be damaged by premature fatigue, so that the best way is that the length of the motor wire 20*g* between the wire inlet 228 and the wire-winding portion 262 is slightly greater than the straight distance between the wire inlet 228 and the wire-winding portion 262, for example, the straight distance between the wire inlet 228 and the wire-winding portion 262 is L1, the length of the motor wire 20*g* between the wire inlet 228 and the wire-winding portion 262 is L2, $1.1\times L1 \leq L2 \leq 1.3\times L2$. Since there are two extreme positions of the moveable plate 20*d*, the length of the motor wire 20*g* between the wire inlet 228 and the wire-winding portion 262 is just slightly greater than the straight distance between the wire inlet 228 and the wire-winding portion 262 when the moveable plate 20*d* is located in the uppermost and the lowermost positions. In the embodiment, the wire inlet 228 can be set in the middle of the maximum travel of the moveable plate 20*d*, that is, the wire inlet 228 is roughly in the middle of the maximum travel of the moveable plate 20*d*.

The above is only an embodiment of the present application, not to limit the scope of the present application, all the equivalent structural changes made under the inventive concept of the present application and the drawings, or direct/indirect application in other related technical fields are included in the scope of the present application.

What is claimed is:

1. A drive mechanism comprising:
a base comprising two guiding slides;
two moveable plates slidably cooperating with the base via the two guiding slides correspondingly;
a rectifying guide rail fixed to the base, wherein the rectifying guide rail is spaced from the two guiding slides, and the rectifying guide rail cooperates with at least one of the two moveable plates; and
two drive motors, each moveable plate comprising one of the two drive motors,
wherein the base is provided with a wire through groove, and
wherein the wire through groove is spaced from the two drive motors in a direction perpendicular to a sliding direction of the two moveable plates.

2. The drive mechanism according to claim 1, wherein:
the wire through groove is provided with a wire inlet.

3. The drive mechanism according to claim 2, wherein:
each of the two drive motors is connected with a motor wire, the motor wire enters into the wire through groove via the wire inlet, and
the wire through groove is provided with a first guiding portion for guiding the motor wire at the wire inlet.

4. The drive mechanism according to claim 3, wherein:
the first guiding portion is extended upward and inclinedly from the wire inlet, or
the first guiding portion is extended downward and inclinedly from the wire inlet.

5. The drive mechanism according to claim 4, wherein:
an additional first guiding portion is provided at the wire inlet, and
one of the two first guiding portions is curved downward from the wire inlet, and the other of the two first guiding portions is curved upward from the wire inlet.

6. The drive mechanism according to claim 1, further comprising a sliding drive assembly connected to a first moveable plate of the two moveable plates, wherein a wire connected to the sliding drive assembly is provided on a side of the base towards a housing.

7. The drive mechanism according to claim 6, wherein:
the base comprises a substrate and two flanks provided at two ends of the substrate respectively,
the substrate is provided with a first side edge whose one end extends toward another end,
the two flanks protrude from the first side edge, and
the two moveable plates are provided on the two flanks respectively.

8. The drive mechanism according to claim 7, wherein:
the sliding drive assembly comprises a motor box and a stepper motor,
the motor box is mounted in a first flank of the two flanks,
the first moveable plate is provided on the first flank,
the motor box is located between the first moveable plate and the first flank,
the stepper motor is mounted in the motor box,
the motor box is provided with a first wire groove,
the wire is connected to the stepper motor, and
the wire is provided in the first wire groove.

9. The drive mechanism according to claim 8, wherein the first wire groove on the motor box in the first flank is provided with an opening towards a second flank of the two flanks.

10. The drive mechanism according to claim 9, wherein a first wire clamping is provided at the opening of the first wire groove.

11. The drive mechanism according to claim 1, wherein:
the base comprises a substrate and two flanks provided at two ends of the substrate respectively,
the substrate is provided with a first side edge whose one end extends toward another end,
the two flanks protrude from the first side edge, and
at least one of the two flanks is provided with the rectifying guide rail.

12. The drive mechanism according to claim 11, wherein the rectifying guide rail is located between the two guiding slides.

13. The drive mechanism according to claim 12, wherein:
each flank is provided with an inner side edge adjacent to the first side edge of the substrate, and
the rectifying guide rail is mounted on the inner side edge.

14. The drive mechanism according to claim 13, wherein:
the inner side edge of each flank is provided with an edge plate, and
the rectifying guide rail is clamped to the edge plate.

15. The drive mechanism according to claim 14, wherein:
the rectifying guide rail comprises a rectifying slide groove and a rectifying rib provided in the rectifying slide groove,
the rectifying slide groove is socketed with the edge plate,
one of the two moveable plates is provided with a guiding groove, and
the guiding groove slidingly cooperates with the rectifying rib.

16. The drive mechanism according to claim 15, wherein an opening of the rectifying slide groove on a first flank of the two flanks is oriented towards a first guiding slide of the two guiding slides that is also located on the first flank, and the rectifying rib is located on a side of the rectifying slide groove away from to the first guiding slide.

17. The drive mechanism according to claim 16, wherein:
the edge plate is provided with a fixing hole, and
an inner wall of the rectifying slide groove is provided with a clamping table corresponding to the fixing hole.

18. The drive mechanism according to claim 17, wherein the clamping table is of a triangular shape.

19. The drive mechanism according to claim 17, wherein each flank is provided with a first fixing groove located on an inner side of the edge plate,
the rectifying slide groove is provided with two side edges that extend in a sliding direction of the edge plate, and
one of the two side edges is provided with a first clasp table for clasping the edge plate, and the other of the two side edges is provided with a second clasp table that cooperates with the first fixing groove.

20. The drive mechanism according to claim 19, wherein:
the first side edge of the substrate is provided with a stop portion,
a second fixing groove is provided between the stop portion and the edge plate, and
the rectifying slide groove is inserted into the second fixing groove.

21. The drive mechanism according to claim 19, wherein the clamping table and the second clasp table are provided at an end of the rectifying slide groove away from the substrate.

22. The drive mechanism according to claim 15, wherein:

the guiding groove is provided with two opposite side walls, each side of the rectifying rib is provided with at least two curved protrusions, and the curved protrusions located on two sides of the rectifying guide rail are abutted against the two opposite side walls of the guiding groove correspondingly.

23. The drive mechanism according to claim 15, wherein:

each flank is provided with the rectifying guide rail, and the two rectifying guide rails are staggered in the direction perpendicular to the sliding direction of the moveable plate.

24. The drive mechanism according to claim 12, wherein:

the rectifying guide rail comprises a rectifying slide groove, one of the two moveable plates is provided with a guiding portion, and the guiding portion is slidably provided in the rectifying slide groove.

25. The drive mechanism according to claim 24, wherein:

the rectifying guide rail further comprises a rectifying rib provided on an inner wall of the rectifying slide groove, and the rectifying rib is abutted against the guiding portion.

26. The drive mechanism according to claim 11, further comprising a sliding drive assembly, where:

the sliding drive assembly comprises a stepper motor and a first gear, the two guiding slides fixed on the two moveable plates respectively, each guiding slide is slidingly provided on the base, and one of the two guiding slides is provided with a rack engaged with the first gear.

27. The drive mechanism according to claim 1, further comprising a panel, wherein the two moveable plates are located between the base and the panel.

28. An air conditioner comprising:

a drive mechanism, wherein the drive mechanism comprises:

a base comprising two guiding slides;

two moveable plates slidably cooperating with the base via the two guiding slides correspondingly;

a rectifying guide rail fixed to the base, wherein the rectifying guide rail is spaced from the two guiding slides, and the rectifying guide rail cooperates with at least one of the two moveable plates; and two drive motors, each moveable plate comprising one of the two drive motors, and an air blocking assembly, wherein the base is provided with a wire through groove, and the wire through groove is provided with a wire inlet, wherein the wire through groove is spaced from the two drive motors in a direction perpendicular to a sliding direction of the two moveable plates, wherein the air blocking assembly is connected to the two moveable plates, and wherein the air blocking assembly is accommodated inside a housing of the air conditioner when in a first state and blocks in front of an indoor air outlet when in a second state.

29. The air conditioner according to claim 28, wherein:

the air blocking assembly is a baffle plate, a microplate or a cyclone module, the baffle plate is configured to block an airflow from the indoor air outlet being blown out forward, the microplate is configured to break up the airflow for being blown out, and the cyclone module is configured to direct the airflow to rotate and be blown out.

30. A drive mechanism comprising:

a base comprising two guiding slides;

two moveable plates slidably cooperating with the base via the two guiding slides correspondingly;

a rectifying guide rail fixed to the base, wherein the rectifying guide rail is spaced from the two guiding slides, and the rectifying guide rail cooperates with at least one of the two moveable plates; and a sliding drive assembly connected to a first moveable plate of the two moveable plates, wherein a wire connected to the sliding drive assembly is provided on a side of the base towards a housing, wherein:

the base comprises a substrate and two flanks provided at two ends of the substrate respectively, the substrate is provided with a first side edge whose one end extends toward another end, the two flanks protrude from the first side edge, the two moveable plates are provided on the two flanks respectively, the sliding drive assembly comprises a motor box and a stepper motor, the motor box is mounted in a first flank of the two flanks, the first moveable plate is provided on the first flank, the motor box is located between the first moveable plate and the first flank, the stepper motor is mounted in the motor box, the motor box is provided with a first wire groove, the wire is connected to the stepper motor, and the wire is provided in the first wire groove.

* * * * *